United States Patent [19]

Fortmann et al.

[11] Patent Number: 5,022,311

[45] Date of Patent: Jun. 11, 1991

[54] COMPACT FLUID ACTUATED WORKING CYLINDER WITH SPRING LOADED TENSIONING MEMBER

[75] Inventors: Norbert Fortmann, Hanover; Helmut Gottling, Isernhagen; Hans F. Meyer, Gehrden; Rudolf Moller, Gehrden; Gerhard Scharnowski, Gehrden, all of Fed. Rep. of Germany

[73] Assignee: WABCO Westinghouse Steuerungstechnik GmbH & Co., Hanover, Fed. Rep. of Germany

[21] Appl. No.: 496,252

[22] Filed: Mar. 20, 1990

[30] Foreign Application Priority Data

Mar. 22, 1989 [DE] Fed. Rep. of Germany ..... 3909344

[51] Int. Cl.[5] ..... F01B 9/00

[52] U.S. Cl. ..... 92/137; 74/110; 474/138

[58] Field of Search ..... 74/89.2, 110; 474/103, 474/104, 110, 113, 117, 136, 137, 138; 92/137, 140

[56] References Cited

U.S. PATENT DOCUMENTS

| | | | |
|---|---|---|---|
| 2,524,271 | 10/1950 | Rappl | 92/137 X |
| 2,943,886 | 7/1960 | Wilkinson | 92/137 |
| 2,960,208 | 11/1960 | Sibley et al. | 92/137 |
| 3,028,693 | 4/1962 | Malzahn | 474/138 X |
| 3,164,027 | 1/1965 | Rood | 474/138 X |
| 3,745,888 | 7/1973 | Boretti | 92/137 X |
| 3,810,397 | 5/1974 | Green | 74/110 |
| 4,121,226 | 10/1978 | Alden | 474/138 X |
| 4,289,177 | 9/1981 | Hammond et al. | 74/110 X |
| 4,472,981 | 9/1984 | Peter | 92/137 X |
| 4,656,881 | 4/1987 | Goedecke et al. | 92/137 X |
| 4,803,804 | 2/1989 | Bryant | 474/136 X |

FOREIGN PATENT DOCUMENTS

| | | |
|---|---|---|
| 1293037 | 12/1969 | Fed. Rep. of Germany . |
| 2359013 | 5/1975 | Fed. Rep. of Germany . |
| 2404244 | 8/1975 | Fed. Rep. of Germany . |
| 2830058 | 9/1979 | Fed. Rep. of Germany . |
| 3005193 | 1/1981 | Fed. Rep. of Germany . |
| 2938332 | 3/1981 | Fed. Rep. of Germany . |
| 2939153 | 4/1981 | Fed. Rep. of Germany . |
| 3016696 | 11/1981 | Fed. Rep. of Germany . |
| 3317113 | 11/1984 | Fed. Rep. of Germany . |
| 3505167 | 8/1986 | Fed. Rep. of Germany . |
| 8801698 | 3/1988 | PCT Int'l Appl. . |
| 2051957 | 1/1981 | United Kingdom . |

*Primary Examiner*—Edward K. Look
*Assistant Examiner*—John Ryznic
*Attorney, Agent, or Firm*—Buchanan Ingersoll

[57] ABSTRACT

A compact fluid actuated working cylinder is disclosed having a cam driven by a piston via a flexible tension member. At the ends of the cylinder housing there are deflection pulleys for providing continuous tension for the tension member. The pulleys are each mounted on pulley supports which extend from secondary bores in the main cylinder housing. The pulley supports are spring loaded and urge the two pulleys away from the cylinder housing and each other. The pulley supports are preferably rectangular in cross-section to protect against torsion.

17 Claims, 3 Drawing Sheets

COMPACT FLUID ACTUATED WORKING CYLINDER WITH SPRING LOADED TENSIONING MEMBER

BACKGROUND OF THE INVENTION

1. Field of the Invention

The present invention relates to a fluid actuated working cylinder having a cam driven by a piston via a flexible tension member. More specifically, this invention relates to a compact working cylinder which utilizes spring loaded deflection elements to maintain constant tension on the tension member.

2. Description of the Prior Art

The prior art is characterized by working cylinders shown in West German Patent No. 28 30 058, U.K. Patent Application 2 051 957 and U.S. Pat. No. 4,472,981. A working cylinder is generally constructed of a cylinder having a two faced piston slidably mounted therein, a cam or other sliding element mounted exterior to the cylinder, and a tensioning member connecting the two elements. A cylinder of this type is utilized to replace a piston and piston rod device because of its generally smaller size, in applications where such size is critical.

The cylinder is generally designed such that a chamber is formed on either side of the piston in the cylinder. The two chambers may be selectively pressurized to move the piston along the longitudinal axis of the cylinder. Movement of the piston thus results in equal movement of the cam on the exterior of the device because of the interconnection therebetween of the tensioning member.

Peter, U.S. Pat. No. 4,472,981 discloses a system in which the piston is mounted within the cylinder and the cam is adapted to be displaced by an inelastic tensioning member. The cam is suspended from the tensioning member and runs longitudinally along the exterior of the cylinder. The primary focus of the reference is the use of springs in the cam member, where the tensioning member is affixed. During operation, the piston and cam are repeatedly and quickly displaced. This rapid and sudden movement tends to wear the rollers and tensioning belts quickly. Springs are utilized to connect the ends of the tensioning belts to the cam, and are adapted to absorb some of the shock of a rapid movement or change of direction of the cam and piston.

During operation of any of the working cylinders, changes in the length of the tensioning member, or deviations in the length of replacement tensioning members is encountered. Additionally, mounting of the tensioning member is time consuming and difficult if the rollers must be permanently adjusted to tension the belt. The relatively small displacement of the springs does not allow for large tension in the tensioning members, nor will it compensate for anything but the smallest of deviations in the length of the tensioning member. Finally, the exterior mounting of the cam and its suspension or support from the tensioning member increase the chances of damage or interference with the movement of the cam.

United Kingdom Application 2 051 957 discloses a device utilizing two interconnected parallel cylinders, one of which is smaller than the other. A piston is mounted in each cylinder, and both are connected by tensioning members from each face to the corresponding face of the other piston. This device thus creates two pressure chambers, formed by the two pistons, one on each set of piston faces. The tensioning members are passed from one cylinder to the other and reverse direction therebetween by being passed over a pulley. The pulleys are connected to shafts which extend outside the cylinder housing and translate the movement of the pistons to other forms. The shafts themselves may be utilized for angular displacement, or pulleys may be mounted thereon with belts mounted across the exterior pulleys to achieve linear displacement in proportion to the movement of the internal pistons and tensioning members.

This device utilizes a self-tensioning system in one embodiment, in which one of the shafts is mounted in a cylinder head which is moveable with relation to the main cylinder housing. The cylinder head is held in position by a plurality of spring loaded studs, which urge the cylinder head away from the main cylinder housing. In this fashion, tension is maintained on both the internal tensioning members and the outer belts, as the shaft about which they are mounted is displaced away from the second, immobile shaft. This device, while providing for tensioning of the tensioning members and external belts, suffers from the same detrimental characteristics as the device described in U.S. Pat. No. 4,472,981. The exterior mounting of the linear motion belts allows for damage or interference with the motion of the device. Similarly, the size of the device is increased by the space required for external pulleys and belts.

Lastly, West German Patent No. 28 30 058 describes a working cylinder having deflection pulleys located in the end areas of the cylinder housing. Each deflector pulley is positioned on an axle that is mounted transverse to the longitudinal axis of the cylinder housing and serves as support for the deflector pulley. Spring-loaded devices are provided which apply loading to the axle in a direction away from the cylinder, so that the tension member is under constant tension.

The disadvantage of this working cylinder is, like the other devices described above, the particular arrangement of the deflector pulleys on the working cylinder. These pulleys are very bulky in design and require considerable space. What is lacking in the art, therefore, is a working cylinder which provides a self-tensioning feature, but is at the same time compact and resistant to external interference with its operation.

SUMMARY OF THE INVENTION

A fluid actuated working cylinder is disclosed which is of compact design and which ensures that the tensioning members are guided securely. The cylinder is more compact because supports for the deflection elements are provided so as to move within an additional housing bore in the cylinder housing. Each support is designed, at least partially, as a tubular body into which extends a spring urging the support away from the cylinder housing. As a result of this measure, the space requirement is considerably reduced for a spring that is large in its axial extension.

A main cylinder housing is provided which has a cylinder extending along its length. Sealing elements are provided at the ends of the cylinder to allow for passage of the tensioning members outside of the cylinder. A piston is mounted within the cylinder and the tensioning members are attached thereto. A track is provided on the outside surface of the main housing. A slidable cam is mounted in the track and is connected to the tensioning members, such that movement of the piston results in an equal but opposite displacement of the cam along the track. The tensioning members are passed over deflection pulleys which extend from the main housing. Covers are provided for each pulley, allowing for a compact, rectangular exterior housing, including the cam mounted on the track.

The pulleys are each mounted on pulley supports which extend from secondary bores in the main cylinder housing. The pulley supports are spring loaded and urge the two pulleys away from the cylinder housing and each other. This maintains tension on the tensioning member. If the secondary bores and the pulley supports have a cross-section that is not circular, e.g., a rectangular cross-section, further protection against torsion is achieved for the support and thus also for the deflector pulley without having to provide an additional torsion safeguard for this purpose. This torsion safeguard guarantees that the tension element is securely guided by means of the deflection pulley. A common housing bore may be provided for both supports, which by means of an insert is divided into two equiaxial housing bore parts.

These and other advantages and features of the present invention will be more fully understood on reference to the presently preferred embodiments thereof and to the appended drawings.

DESCRIPTION OF THE PREFERRED EMBODIMENTS

Figure 1:
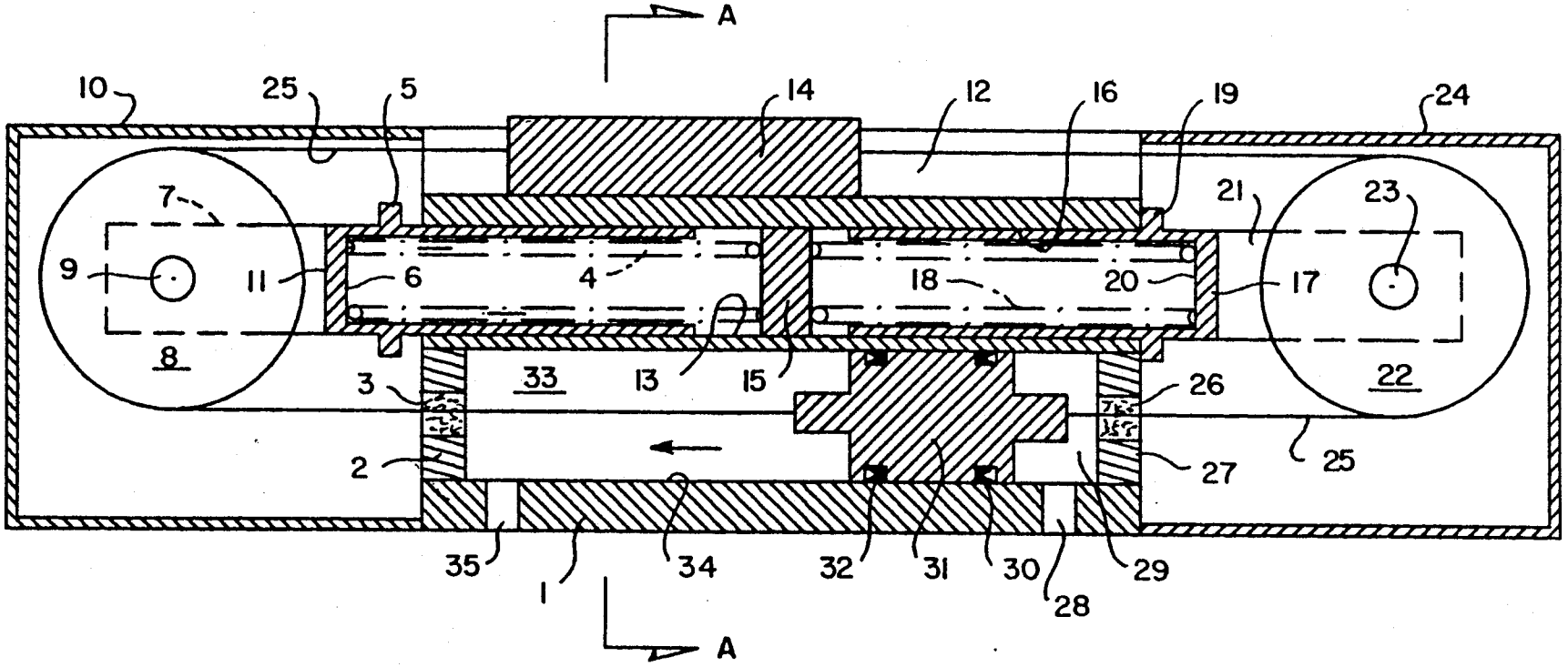
FIG. 1 is a sectional view of the working cylinder.

In FIG. 1, the working cylinder is illustrated having a profile tube functioning as cylinder housing 1 with a first housing bore 34 oriented in the direction of the longitudinal axis of the cylinder housing 1. The first housing bore 34 may have a circular cross-section, but preferably has a cross-section that deviates from the circular shape, e.g. an oval one. A piston 31 sealed with sealing rings 30 and 32, is movably mounted in the first housing bore 34. The shape of the piston 31 cross-section must necessarily correspond to the shape of the cross-section of the first housing bore 34. The ends of the first housing bore 34 are sealed with a first cover 2 and a second cover 27.

The piston 31 divides the cylinder chamber into a first working chamber 33 and a second working chamber 29. The first working chamber 33 is connected to an external source of hydraulic fluid or a return (not shown) by pressure-medium connection 35. The second working chamber 29 is likewise connected to a hydraulic fluid source or return (also not shown) through second pressure-medium connection 28. The two working chambers 33 and 29 can thus be optionally connected to a pressure-medium source or to atmosphere or a return flow.

An opening having a sealing element 3 is provided in the first cover 2 and another opening having a sealing element 26 is provided in the second cover 27. Tension member 25, which is connected to each face of the piston, is passed, through sealing elements 3 and 26, out of the front ends of the cylinder.

A guide 12 is mounted exteriorly on the cylinder housing 1 and is provided for a cam 14 that is slidably mounted thereon. The cam 14 is movable longitudinally along cylinder housing 1. Tension member 25 extends from the faces of the piston 31 to the cam 14. As shown in FIG. 1, a tension member 25 extends from each face of the piston 31 and is affixed to each face of the cam 14. It is specifically intended that the tension member 25 be comprised of either a single element or individual elements passing from each face of the piston 31 to the cam 14. As a single element, the tension member 25 may pass through the piston 31, through the cam 14, through both or be comprised of two individual elements.

The cylinder housing 1 has at least one secondary bore extending at least partially therethrough, and parallel to the first housing bore 34. The secondary bore may be comprised of a single bore which extends throughout the entire cylinder housing 1, or may be alternatively two separate bores. As shown in FIG. 1, the secondary bore is a single bore which is divided into a pair of secondary bores 13 and 16 by an insert 15. Two inserts, each providing an end for a bore portion, may also be utilized. As stated previously, secondary bores 13 and 16 may be independent bores, with insert 15 being an integral portion of the cylinder housing 1.

Figure 1A:
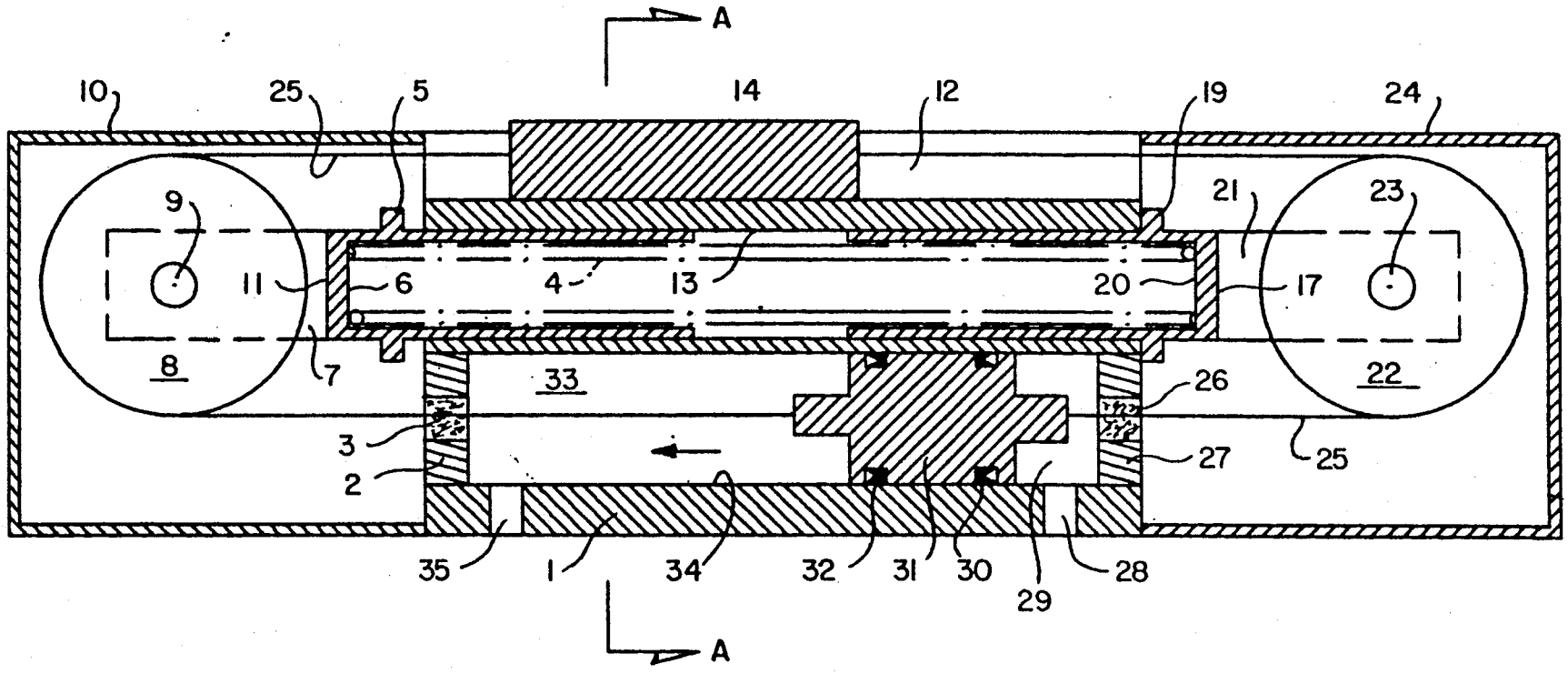
FIG. 1*a* is a sectional view of a second embodiment of the working cylinder.

As shown in FIG. 1*a*, the insert 15 may be entirely eliminated, and a single secondary bore 13 be utilized which extends unimpeded through the cylinder housing 1.

The longitudinal axis of the first housing bore 34, the longitudinal axis of the secondary bores 13 and 16 and the longitudinal axis of the guide 12 for the cam 14 run parallel to each other and parallel to the longitudinal axis of the cylinder housing 1.

Deflection devices are provided for the support and alignment of the tension member 25, which passes thereover. The number of deflection devices correspond to the number of secondary bores. In the preferred embodiment, two deflection devices are utilized. Each deflection device is preferably identical and comprised of a deflection support 11 or 17 and a deflection element. The deflection element is preferably a pulley 8 or 22 held in place by a fork 7 or 21, respectively. In secondary bore 13, a first deflection device is slidably mounted for support of a first pulley 8 that serves as deflection element for the tension member 25 on the left side of the device, as shown in FIG. 1. The deflection support 11 is movable and slides in the direction of the longitudinal axis of the second housing bore 13. In the same manner, a second deflection support 17 for the second pulley 22 functions as deflecting element for the tension element 25 on the right side of the device, as viewed in FIG. 1. The second deflection support 17 is also mounted so as to move in the direction of the longitudinal axis of the second housing bore 16.

Figure 2:
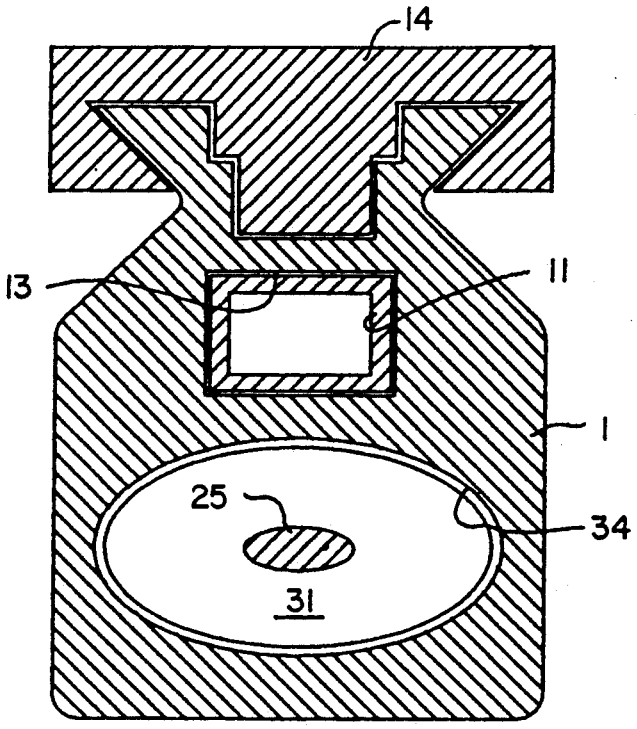
FIG. 2 is a sectional view through the working cylinder of FIG. 1 along line A—A.
Figure 3:
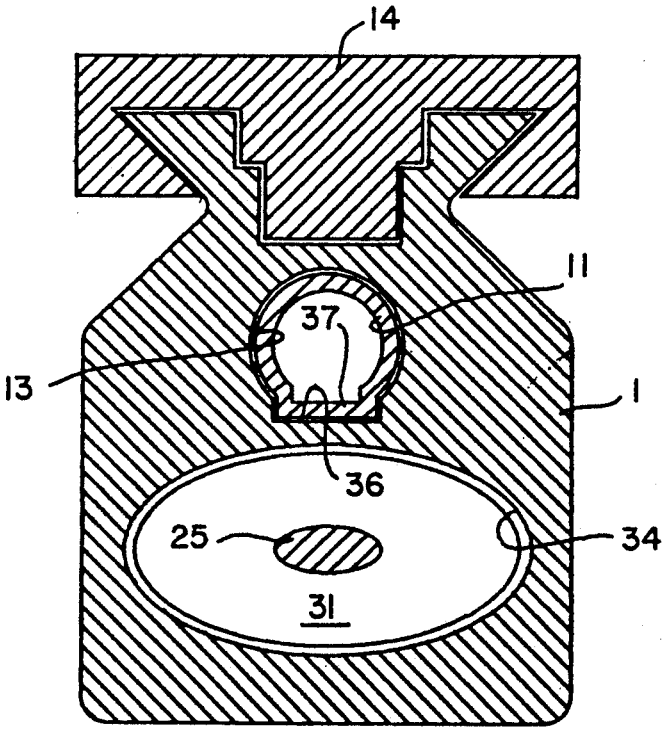
FIG. 3 is a sectional view of a third embodiment of the working cylinder, taken along a line similar to that of FIG. 2.

Referring to FIGS. 1 and 2, the cross-section of the secondary housing bores 13 and 16 (not shown in FIG. 2) and the associated deflection supports 11 and 17 are preferably rectangular. An alternative embodiment of the device is shown in FIG. 3. If the deflection supports 11 and 17, corresponding to secondary housing bores 13 and 16 have a circular cross-section, there is a possibility of limited torsional forces being exerted on the deflection supports 11 and 17 within the secondary bores 13 and 16, protection against such torsion can be achieved by providing a groove 36 in the wall of the secondary housing bores 13 and 16, the groove running in the longitudinal direction of the secondary housing bores 13 and 16. A projection 37 extending outwardly from the surface of the deflection supports 11 and 17 serves to eliminate any effect of torsion on the deflection supports 11 and 17, keeping tension member 25 in proper alignment.

FIG. 2 shows cylinder housing 1 having a first housing bore 34 with piston 31 inserted therein. The first deflection support 11 is shown inserted within second housing bore 13 and the cam 14 is mounted in guide 12. It is clearly evident from this figure that the first housing bore 34, the secondary housing bores 13 and 16 and the cam 14 are arranged, one above the other, on a common vertical axis. This applies equally to the embodiment shown in FIG. 3.

The two deflection supports 11 and 17 are preferably designed as tubular bodies having forks 7 and 21 extending therefrom. The forks 7 and 21 extend outwardly from the secondary bores 13 and 16 from cylinder housing 1. The fork 7 of the first deflection support 11 has an axle 9 which runs transverse to the longitudinal axis of the first deflection support 11 and on which the first pulley 8 is mounted so as to rotate. The fork 21 of the second deflection support 17 also has an axle 23, which runs transverse to the longitudinal axis of the second deflection support 17 and on which the second pulley 22 is rotatably mounted.

A resilient means, in the form of first spring 4 is located in the tubular body of the first support 11, whose axial extension is greater than the axial extension of the tubular body of the first deflection support 11. The tubular body is closed at the outermost end by fork 7 or 21. The interior space of the deflection support 11 or 17 is thus sealed by an end face 6 or 20, respectively. One end of the first spring 4 abuts the insert 15 between secondary housing bores 13 and 16. The other end of first spring 4 abuts the end face 6 of the first deflection support 11. A second spring 18 is located within the tubular body of the second deflection support 17 whose axial extension is also greater than the axial extension of the tubular body of the second support 17. The second spring 18, like first spring 4, abuts insert 15 in the secondary housing bore and extends through the interior space of the deflection support 17, terminating against end face 20.

The first spring 4 urges the first deflection support 11 in the direction of the longitudinal axis of the cylinder housing 1, directed away from cylinder housing 1. The second spring 18 urges the second deflection support 17 in the direction of the longitudinal axis of the cylinder housing 1, directed away from the cylinder housing 1. These forces, in turn urge the pulleys 8 and 22 in the same direction.

In the second embodiment shown in FIG. 1*a*, the insert 15 has been omitted, and a single spring 4 is utilized instead of two separate springs to provide the force necessary to urge the first and second deflection supports 11 and 17 away from each other.

The deflection supports 11 and 17 which support a pulley s and 22, respectively, may consist, at least partially, of a tubular body, which may serve to accept the associated tension spring for supports of the pulley. However, the deflection support may also consist of solid material, thus moving the end faces to the innermost terminal points of the deflection supports. In this way, the spring acts upon the deflection support end surface which is inserted into the secondary housing bore.

The tension member 25 connects piston 31 to the cam 14 and is run over the two pulleys 8 and 22. The tension member 25 is held under constant tension because of the application of spring forces to the two pulleys 8 and 22 in the direction away from each other and the cylinder housing 1.

The deflection supports 11 and 17 utilize stops 5 and 19 outside of the secondary housing bore mounted on their external surface, which during movement of the deflection supports 11 and 17 in the direction toward the cylinder housing 1 can make contact at the associated front end of the cylinder housing 1 and thus limit the stroke of the deflection support 11 or 17 in that direction. The maximum elongation of tension member 25 is utilized to restrain the deflection devices and provides the means by which the deflection devices are retained in cylinder housing 1.

Stops 5 and 19 may be omitted if the length of the deflection supports 11 and 17 is such that the deflection supports 11 and 17 contact the insert 15 with their end surfaces which have been inserted into secondary housing bores 13 and 16. Additionally, the deflection supports may be stopped by the bottom of the individual bores, when such individual bores are utilized. It is also possible that each spring 4 or 18 itself functions as a stop, if it is in a completely compressed state (winding against winding) or if the spring is extremely extended.

It is specifically noted that several other bores for retaining and guiding several supports for deflection elements in the cylinder housing may be provided. The secondary housing bores 13 and 16 may be in a slightly slanted position in cylinder housing 1 with relation to the longitudinal axis of the cylinder housing 1. The fork of each deflection support carrying the pulley may also be angled.

At the two ends of the cylinder housing 1, covers 10 and 24 are utilized to enclose the deflection forks 7 and 21 and pulleys 8 and 22 to protect these components from dirt.

In operation, if there is no pressure in the two working chambers 33 and 29 or if the same pressure prevails therein, then the deflection supports 11 and 17 with the pulleys 8 and 22 are retained in the secondary bores 13 and 16 by means of the tension member 25. The tension member 25 opposes the force of the springs 4 and 18, and the deflection devices are maintained at some equilibrium position.

When pressure-medium is applied to the second working chamber 29 and the pressure reduced in the first working chamber 33, the piston 31 is moved in the direction of the first working chamber 33, the direction of arrow X shown in FIGS. 1 and 1*a*.

The tension member 25 is under tension on the side that partially loops around pulley 22. The tension member 25 is under tension because the cam 14 is being moved (pulled) by the tension member 25 and piston 31 to the right, as shown in FIG. 1. This forces deflection support 17 inwardly, with respect to cylinder housing 1, until stop 19 abuts cylinder housing 1.

At the same time, the part of the tension member 25 that partially loops around the first pulley 8, i.e., that part between cam 14, first pulley 8 and piston 31, is being relieved during this process. This creates a slight play between the first pulley 8 and the tension member 25. The support 11 carrying the first pulley 8 is moved by the force of the spring 4 to the left, as shown in FIG.

1, away from the associated face of the cylinder housing 1. This causes the stop 5 of the first support 11 to move away from the face of the cylinder housing 1 and allows the tension member 25 to remain under continued tension.

Likewise, when the piston 31 moves in the direction toward the second working chamber 29 and with the resulting movement of the cam 14 to the left, as shown in FIG. 1, the portion of the tension member 25 partially looping the first to pulley 8, i.e., that portion between cam 14, first pulley 8 and piston 31, is under increased tension. The portion of the tension member 25 partially looping the second pulley 22, i.e, that portion between cam 14, second pulley 22 and piston 31, is therefore being relieved. The first deflection support 11 is forced, against the force of the spring 4, into the additional housing bore 13 by the force acting upon the tension member 25. This continues until stop 5 of the first support 11 comes to rest against the associated front face of the cylinder housing 1.

As the tension in tension means 25 which is partially looping around the second pulley 22, first deflection support 11 is relieved, the force of the second spring 18 acting upon the second deflection support 17 moves the second deflection support 17 away from the associated front side of the cylinder housing 1, allowing stop 19 to move away from the side of the cylinder housing 1. The tension member 25 is thus kept under tension in the section between the cam 14, the second pulley 22 and the piston 31 by the second pulley 22.

While we have described a present preferred embodiment of the invention, it is to be distinctly understood that the invention is not limited thereto but may be otherwise embodied and practiced within the scope of the following claims.

We claim:

1. A fluid actuated working cylinder having a cam driven by a piston through a flexible tension member, comprising:

a) a first housing bore provided in a cylinder housing, the first housing bore longitudinally oriented in the cylinder housing, the piston being slidably mounted within said first housing bore;

b) a guide provided on the cylinder housing, upon which the cam is guided longitudinally to the cylinder housing;

c) a plurality of deflection devices resiliently mounted opposite each other on said cylinder housing, each having a deflection element and a deflection support mounted thereon, the deflection support slidably mounted within an additional housing bore of the cylinder housing and urged outwardly from the cylinder housing, the additional housing bore adapted to accept at least part of the deflection support and the deflection element adapted to engage the flexible tension member such that the tension member is under tension.

2. A fluid actuated working cylinder as described in claim 1, wherein the application of resilient forces upon the deflection devices is essentially in the direction of the longitudinal axis of the cylinder housing.

3. A fluid actuated working cylinder as described in claim 1, wherein the deflection element is a pulley which is rotatably mounted on the deflection support.

4. A fluid actuated working cylinder as described in claim 1, wherein each deflection support is a solid member.

5. A fluid actuated working cylinder as described in claim 1, further comprising a resilient member mounted within the additional housing bore engaging the cylinder housing and the deflection support.

6. A fluid actuated working cylinder as described in claim 5, wherein each deflection support has an interior end, which is mounted inwardly within the additional housing bore, said interior end engaging the resilient member, the deflection support being urged along its longitudinal axis thereby.

7. A fluid actuated working cylinder as described in claim 5, wherein the resilient force for each deflection device is produced by a common resilient member located in a common additional housing bore and which engages the each deflection support.

8. A fluid actuated working cylinder as described in claim 1, wherein the deflection supports are comprised at least partially as a tubular body.

9. A fluid actuated working cylinder as described in claim 8, wherein a resilient member extends at least partially into the associated tubular deflection support.

10. A fluid actuated working cylinder as described in claim 9, wherein the dimension of each resilient member in the direction of its axial reach is such that it projects from the associated tubular deflection support with the resilient member abutting at one end against an insert located in the additional housing bore and urging the associated tubular deflection support away from the cylinder housing.

11. A fluid actuated working cylinder as described in claim 8, wherein a common resilient member is utilized for the deflection supports in the additional housing bore and the common resilient member extends into the tubular deflection supports.

12. A fluid actuated working cylinder as described in claim 11, wherein the measurement of the axial reach of the resilient member is such that it urges each deflection support in the direction away from the cylinder housing.

13. A fluid actuated working cylinder as described in claim 1, wherein the additional housing bore has a cross-section other than circular.

14. A fluid actuated working cylinder as described in claim 13, wherein the additional housing bore and associated deflection support have a rectangular cross-section.

15. A fluid actuated working cylinder as described in claim 1, further comprising a stop member mounted on each deflection support, the stop limiting the travel of the deflection support within the additional housing bore in the direction toward the cylinder housing.

16. A fluid actuated working cylinder as described in claim 15, wherein the stop member is located on the surface of the deflection supports, and mounted exterior to the additional housing bore.

17. A fluid actuated working cylinder as described in claim 1, wherein the surface of each deflection support has a projection and wherein the additional housing bore has a corresponding recess extending longitudinally therealong, said projection adapted to slidably move within said recess and prevent torsional movement of the deflection support within said additional housing bore.

* * * * *

UNITED STATES PATENT AND TRADEMARK OFFICE

CERTIFICATE OF CORRECTION

PATENT NO. : 5,022,311

DATED : June 11, 1991

INVENTOR(S) : NORBERT FORTMANN, HELMUT GOTTLING, HANS F. MEYER, RUDOLF MOLLER, GERHARD SCHARNOWSKI

It is certified that error appears in the above-identified patent and that said Letters Patent is hereby corrected as shown below:

Column 5, line 62, after "pulley" delete "s" and insert --8--.

Column 7, line 10, after "first" delete "to".

Signed and Sealed this

Twentieth Day of October, 1992

*Attest:*

DOUGLAS B. COMER

*Attesting Officer*

*Acting Commissioner of Patents and Trademarks*